US006085867A

United States Patent [19]

Daniel, III et al.

[11] Patent Number: 6,085,867

[45] **Date of Patent: *Jul. 11, 2000**

[54] MODULAR PLATFORM SYSTEM

[75] Inventors: James P. Daniel, III; Robert A. Cooksey, both of Florence, S.C.

[73] Assignee: Aluminum Ladder Company, Florence, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/322,518

[22] Filed: May 28, 1999

[51] Int. Cl.[7] ..... E06C 7/16

[52] U.S. Cl. ..... 182/151; 182/115; 182/113

[58] Field of Search ..... 182/83, 115, 151, 182/113; 52/182, 183

[56] References Cited

U.S. PATENT DOCUMENTS

| | | | |
|---|---|---|---|
| 3,698,411 | 10/1972 | Dohan | 182/113 |
| 3,808,757 | 5/1974 | Greenwood | 182/115 |
| 4,042,064 | 8/1977 | Lobb | 182/115 |
| 5,653,459 | 8/1997 | Murphy | 182/113 |

*Primary Examiner*—Alvin Chin-Shue
*Attorney, Agent, or Firm*—Hardaway/Mann IP Group

[57] ABSTRACT

A modular platform system comprising at least one platform unit of a predetermined length, the platform unit having predrilled holes at predetermined intervals; at least one stair unit of a predetermined length connectable with at least one platform unit, the stair unit further comprising a number of steps connectable by a pair of side rails, the side rails causing the steps to slant in a downward direction at a predetermined angle; at least one end unit of a predetermined height connectable with at least one platform unit; at least one stair railing unit of a predetermined length connectable to at least one platform unit and to at least one stair unit; and, at least one platform railing unit of a predetermined length connectable to at least one platform unit, wherein a platform system of varying dimensions can be customized by a user.

7 Claims, 11 Drawing Sheets

MODULAR PLATFORM SYSTEM

BACKGROUND OF THE INVENTION

1. Field of the Invention

The present invention relates broadly to scaffolding, and more particularly to a modular platform system of connectable units by which a user can customize a platform system as desired.

2. Discussion of Background

A variety of platform systems have been employed to provide workers with a suitable and safe area from which to perform their tasks, whether inside an industrial plant, elevated above and/or over equipment, or beside a particular structure.

Modular systems have also been developed for use near building structures. For example, U.S. Pat. No. 4,967,875 to Beeche discloses a modular scaffolding system attached to a frame where platforms are attached to vertical support columns at preselected levels.

U.S. Pat. No. 4,293,054 to Pieri discloses modular scaffolding for supporting a lifting working bridge and a lifting platform, the frame supporting a motor and a brake unit.

U.S. Pat. No. 5,617,931 to Zygmum discloses a modular scaffolding system including interconnectable side walls or side tresses with interchangeable decks and section connectors to simplify transportation and storage.

In addition, modular systems have been developed for other uses. For example, U.S. Pat. No. 5,829,202 to Canton Gongora et al., discloses a system of internal modular structures for creating an office environment. U.S. Pat. No. 5,845,875 to Deel discloses a modular launch pad for a launch vehicle having a plurality of building units separably connected to a frame of U-shaped channel sections. U.S. Pat. No. 5,810,507 to Ahlskog et al., teaches a modular bridge-deck system. And, U.S. Pat. No. 5,820,111 to Ross teaches a modular stairway and balcony railing system for long term industrial uses.

Although the prior art has addressed the need for a variety of modular systems, including platform systems, there remains a need in the art for multi-access platform systems which can be tailored by the user for a particular task, and which can provide multi-access levels, as well as safety features for accessing. There remains a need for platform systems which are lightweight and easily assembled by the end user. The platform systems should also be able to adapt to a wide variety of applications and provide sufficient rigidity to provide a safe work place for the user. The platform system should additionally provide a level of security for the user by providing features such as slip resistant surfacing. Thus, there remains room for improvement in the art.

SUMMARY OF THE INVENTION

It is, thus, an object of this invention to provide a platform system which is lightweight, easy to assemble and durable.

It is also an object of this invention to provide a multi-access platform system which can be combined to build units of varying heights and widths.

It is a further object of this invention to provide a platform system which can accommodate multiple platform heights.

It is an even further object of this invention to provide a platform system which can accommodate the connection of several platforms together.

It is an even further object of this invention to provide a platform system which can accommodate a variety of stairway entries.

These and other objects of this invention are provided by a modular platform system, comprising at least one platform unit of a predetermined length, said platform unit having predrilled holes at predetermined intervals; at least one stair unit of a predetermined length connectable with said at least one platform unit, said at least one stair unit further comprising a number of steps connectable by a pair of side rails, said side rails causing said number of steps to slant in a downward direction at a predetermined angle; at least one end unit of a predetermined height, said end unit connectable with said at least one platform unit; at least one stair railing unit of a predetermined length, said stair railing unit connectable to said at least one platform unit and to said at least one stair unit; and, at least one platform railing unit of a predetermined length, said platform railing unit connectable to said at least one platform unit, wherein a platform system of varying dimensions can be customized by a user.

DETAILED DESCRIPTION

Figure 1:
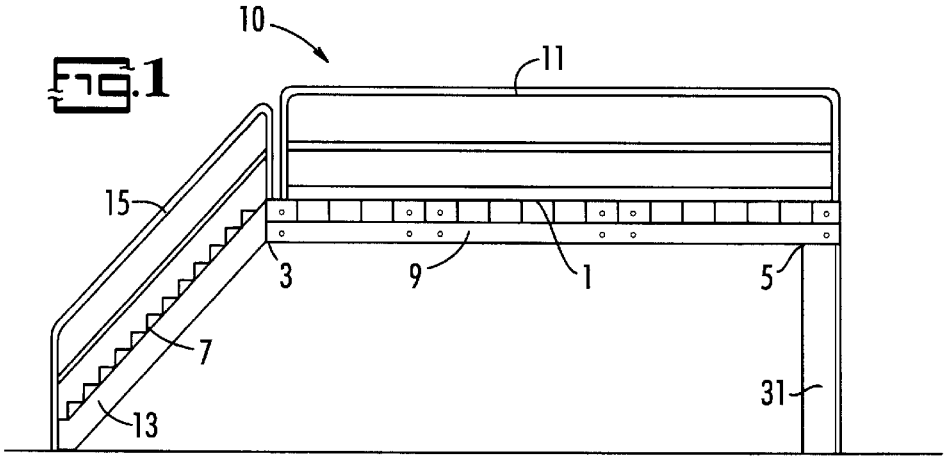
FIG. 1 is a perspective view of one embodiment of the present invention.
Figure 2:
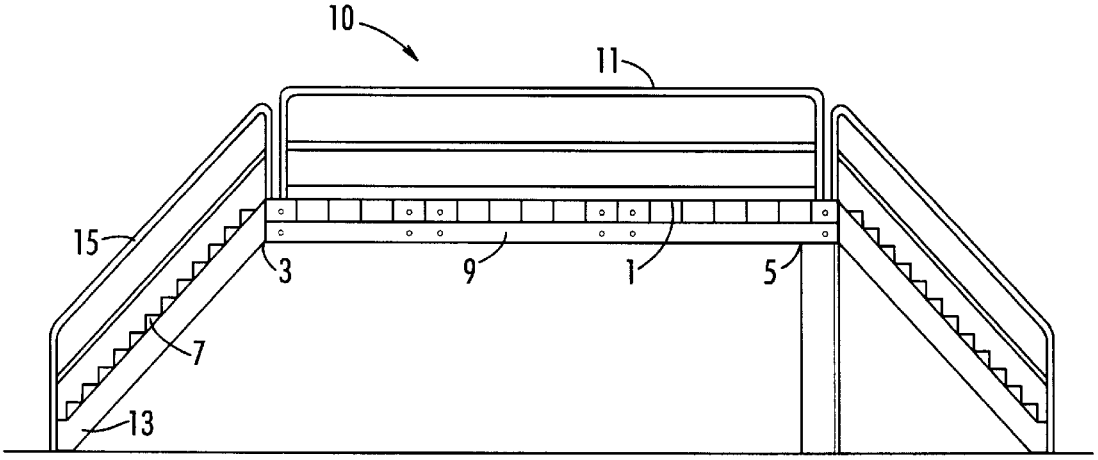
FIG. 2 is a perspective view of another embodiment of the present invention.
Figure 6:
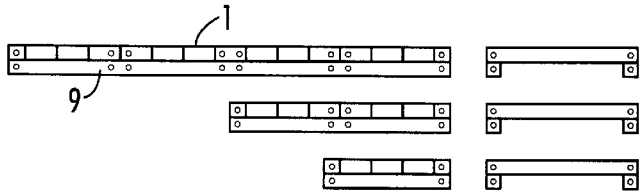
FIG. 6 is a schematic representation of a number of embodiments of the platform units of the present invention.

In accordance with the present invention as described herein, it has been found that a platform system 10 or structure may be made by combining the various system components of the present invention. As shown in FIGS. 1 and 2 of the drawings, a modular platform system 10 is disclosed comprising a platform unit 1 (further shown in FIG. 6) which is connectable or supportable on at least two ends, for example a first end 3 and a second end 5. Platform unit 1 may be supported in a number of combinations, including but not limited to being supported by a stair unit 7 and an end unit 31 as shown in FIG. 1, by two stair units 7 as shown in FIG. 2, or by any combination thereof.

Platform unit 1 comprises ledge portion 9 about the perimeter of the platform unit 1. The ledge portion 9 is preferably integral with platform unit 1 and comprises holes for fastening a stair unit 7, an end unit 31, associated railing and the like, to the platform unit 1. In any instance, platform unit 1 must be supported on at least two ends to provide an adequately supported structure.

Platform unit 1 is at least partially enclosed by platform railing 11 which are sized to accommodate the length or width of the platform unit 1. The platform railing 11 provides a type of safety enclosure for the worker on the platform unit 1, providing protection for the worker and, potentially, those working around him or her. The platform unit 1 and stair units 7 are preferably standard 30 inch wide units comprising aluminum. The stair units 7 may also comprise side rails 13 and stair railings 15 made of aluminum which provide structural support as well as safety of the system user. In a preferred embodiment of the present invention, the platform unit 1 may further comprise a slip resistant surfacing such as an aggressive Alco-Lite® aluminum decking or some similar slip resistant surfacing to improve footing (see for example surface 51 in FIG. 8). Thus, the worker or user of the platform is less prone to slipping and falling on the platform unit 1.

A combination of components, including but not limited to platform units 1, stair units 7, platform railings 11, stair railings 15 and end units 31 can be combined to build a custom modular platform system similar to system 10. The platform system 10 resulting from the combination of components described above can produce a platform system 10 having varying dimensions. In a preferred embodiment of the present invention, custom built platform heights can range anywhere from around 18 inches to 81 inches in approximately 9 inch increments. The component dimensions, in any instance, should all comport with OSHA standards. In addition, a preferred embodiment of the present invention provides that the stair railing 15 height is at least 32 inches, and the platform railing 11 height is at least 42 inches with a 5 inch toe board. These preferred dimensions ensure that OSHA requirements are met.

To aid in assembly, all platform units 1 are predrilled at 30 inch increments around side members 9 to allow for easy configuration and alignment of the various components to the platform unit 1. Fasteners such as screws or bolts, or welding may be used to attach any component to the platform unit 1. In a preferred embodiment, the fasteners comprise stainless steel to avoid rusting problems and to extend the useful life to the platform system.

Figure 3:
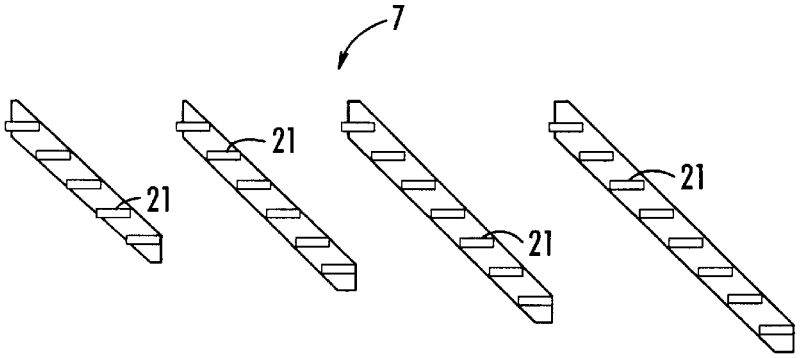
FIG. 3 is a schematic representation of a number of embodiments of the stair units of the present invention.

With reference to FIG. 3, four embodiments of the stair unit 7 are shown. These embodiments are by no means the only stair unit embodiments that can be used with this invention. Each stair unit 7, however, should at least comprise a number of steps 21 secured in place and in communication with a side rail member 13. As further seen in FIG. 12, side rail 13 comprises ledge 23, which includes a front ledge portion 23F further comprising holes for securing the stair unit 7 to another system component.

Each stair unit 7 is preferably a prefabricated unit; that is the steps 21 and the side rail 13 are pre-constructed to have a 45 degree stair slope. The steps 21 are also, preferably, 9½ inches deep. The slope and depth of the stair unit 7 combine to provide a stair unit 7 which is comfortable to climb and/or descend, requiring little concentration from the user.

Figure 4:
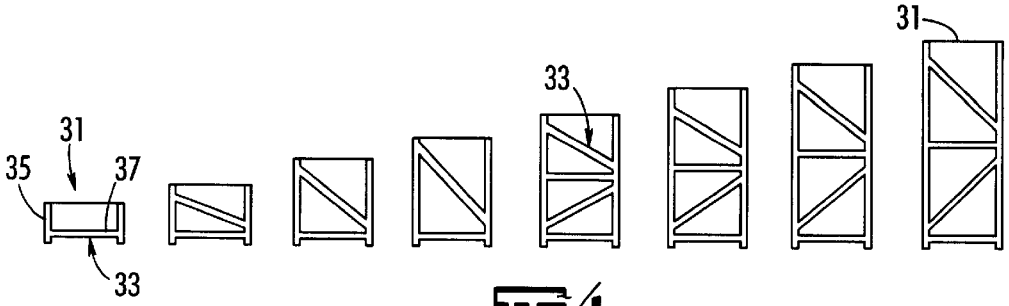
FIG. 4 is a schematic representation of a number of embodiments of the end units of the present invention.

With reference to FIG. 4, several embodiments of the end unit 31 for the present invention are shown. Each end unit 31 is preferably a prefabricated unit varying incrementally in height. Each end unit 31 comprises a support system 33 which also varies as the height of the end unit 31 increases or decreases. Support system 33, for example, may comprise a single girder member 37 in communication with the legs 35 of the end unit 31 to provide a sturdy and rigid structure. As the height of the end unit 31 increases, the support system 33 may comprise a number of girder members 37 in communication with the legs 35 of the end unit 31 positioned to provide additional support and rigidity to the end of unit 31. In accordance with this invention, a properly constructed platform unit 1 can accommodate at least 50 pounds per square foot weight capacity.

Figure 5:
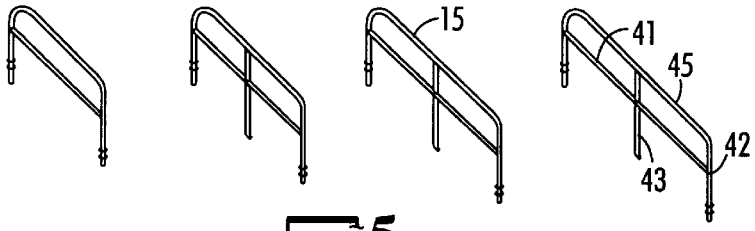
FIG. 5 is a schematic representation of a number of embodiments of the stair railings of the present invention.
Figure 7:
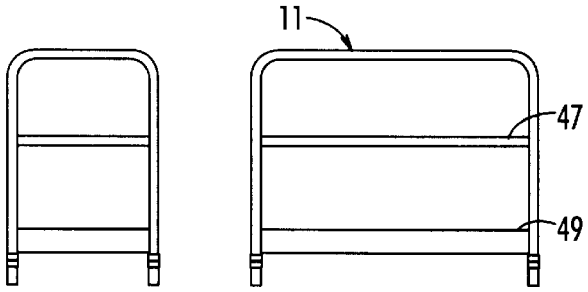
FIG. 7 is a schematic representation of a number of embodiments of the platform railings of the present invention.

Looking now to FIGS. 5 and 7, a number of embodiments of stair railings 15 and the platform railings 11 are shown. Like the other components of the platform system 10, the railings 11 and 15 are preferably prefabricated. Each platform railing 11 is preferably an inverted U-shaped member comprising a first horizontal member 47 connected between the legs of the inverted U-shaped member approximately half way between a top and bottom of the U-shaped member. Platform railings 11, and thus the horizontal member 47, increase incrementally in length as is needed to compliment the incrementally varying lengths of platform unit 1. The platform railing 11 further comprises a second horizontal member 49 located near the bottom of the inverted U-shaped member. The first and second horizontal members 47 and 49 provide a grasping means for a user working on the platform unit 1. The second horizontal member 49 further acts as a toe board to preclude a user's foot from slipping through the platform railing 11 and causing injury. Additionally, any tools or items in the users possession can be safely put on the platform surface without fear of the item rolling off of the platform unit 1 onto another individual or structure below the platform unit 1.

Figure 16:
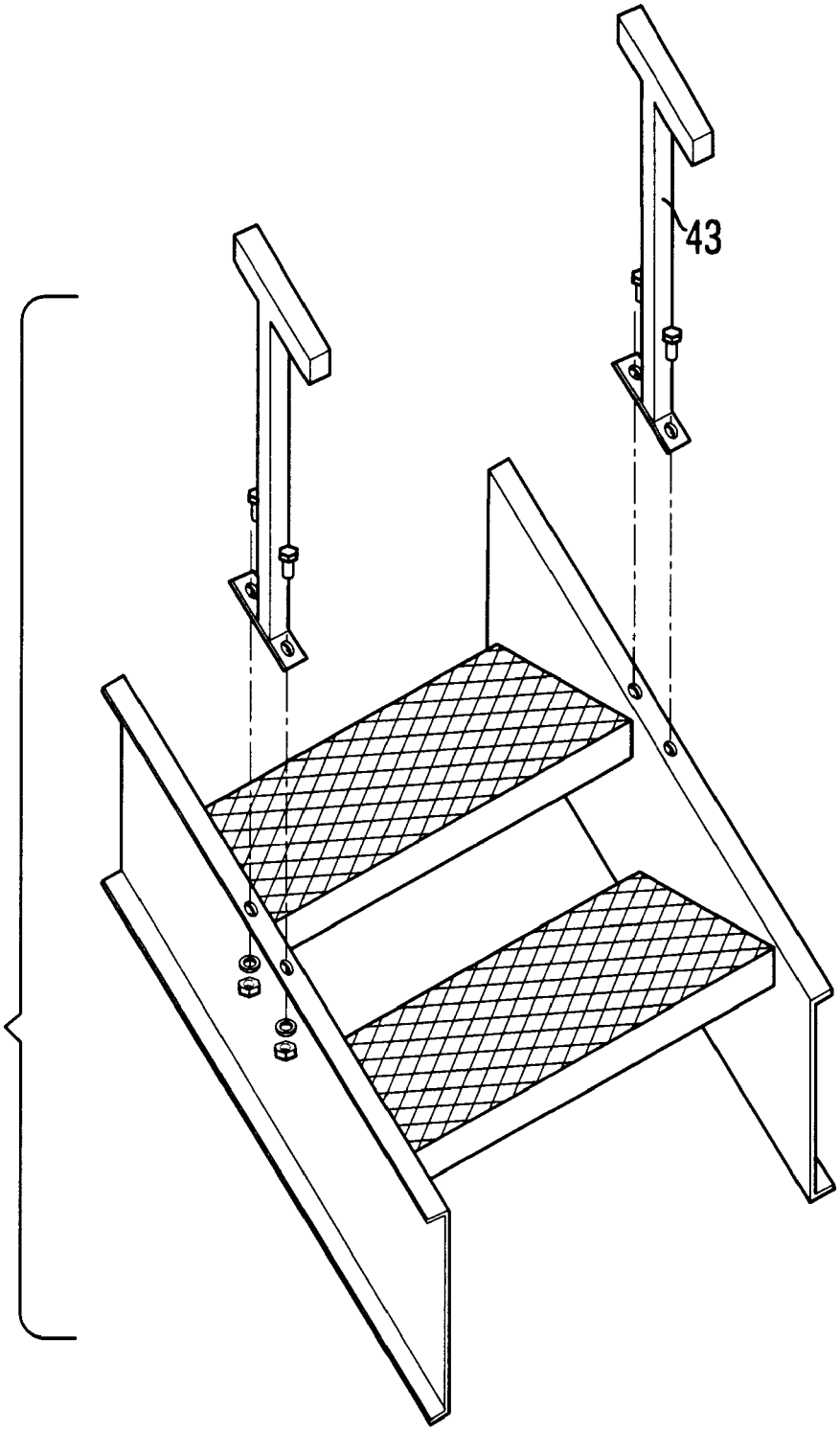
FIG. 16 is a schematic representation of a vertical member of a stair railing being joined to a stair unit and the positioning of the fastener holes and connector means.

Each stair railing 15, like platform railing 11, is provided as an inverted U-shaped member 45 comprising a vertical member 43 and a horizontal member 41 arranged in a cross-like configuration. The stair railing 15, may be provided such that the vertical legs 42 of the U-shaped member are weldably attached to form the U-shaped member. In any instance, each stair railing 15 is provided in incremental lengths to compliment the length of the stair unit 7 to which it is being attached. OSHA requires that vertical member 43 be provided for every six feet of stair railing 15. As shown in FIG. 16, vertical member 43 is attachable to an upper portion of ledge 23 of stair member 7. Vertical member 43 is also weldably connectable to the U-shaped member 45 to provide a stable structure. The stair railing 15 provides additional safety for the user and may be connected on one or both sides of the stair unit 7.

Figure 8:
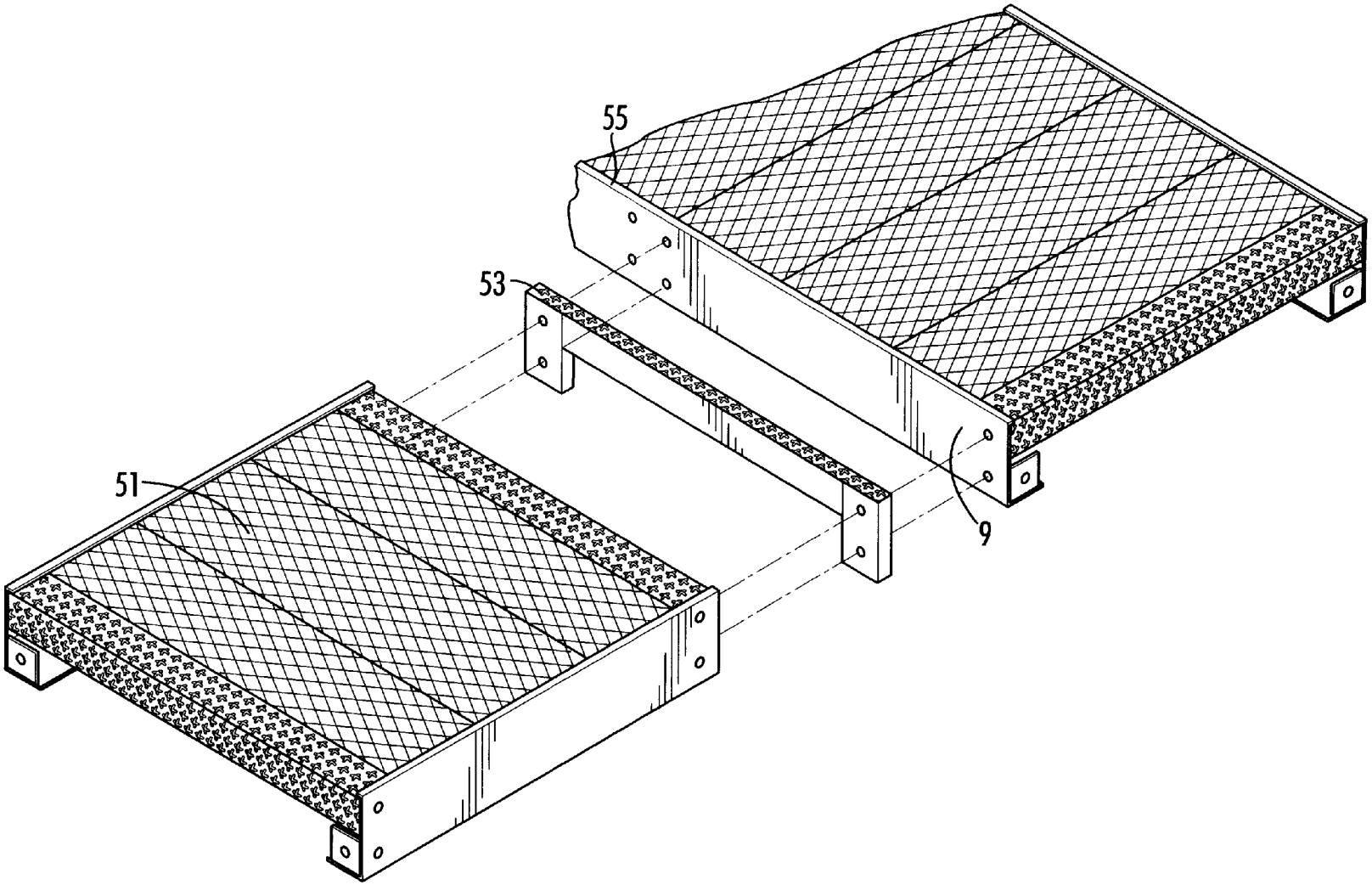
FIG. 8 is a perspective view of two platforms being joined utilizing an adapter member and of the positioning of the fastener holes.

As shown in FIG. 8, two platform units 1 can be combined to provide an extended working area and/or to accomplish a change in direction for the platform system 10. For example, one platform unit 1 may be mated to a side 55 of ledge 9 of another platform unit 1. In this instance, an adapter 53 may be utilized to avoid any gapping between the platform units 1 and to provide a more secure fit. Adapter 53 is also preferably comprised of aluminum.

Figure 9:
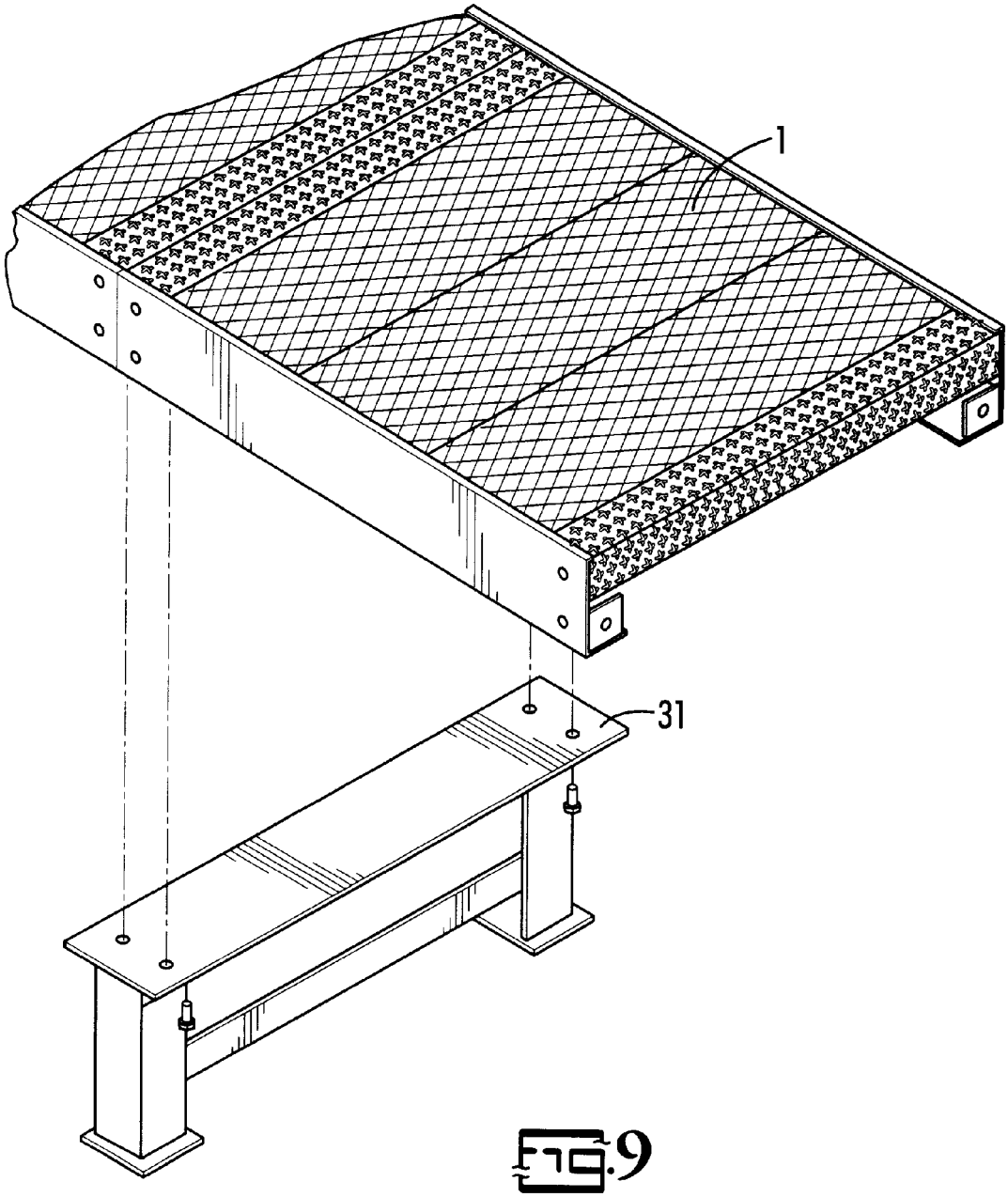
FIG. 9 is a perspective view of a platform member being joined to an end support and of the positioning of the fastener holes.
Figure 10:
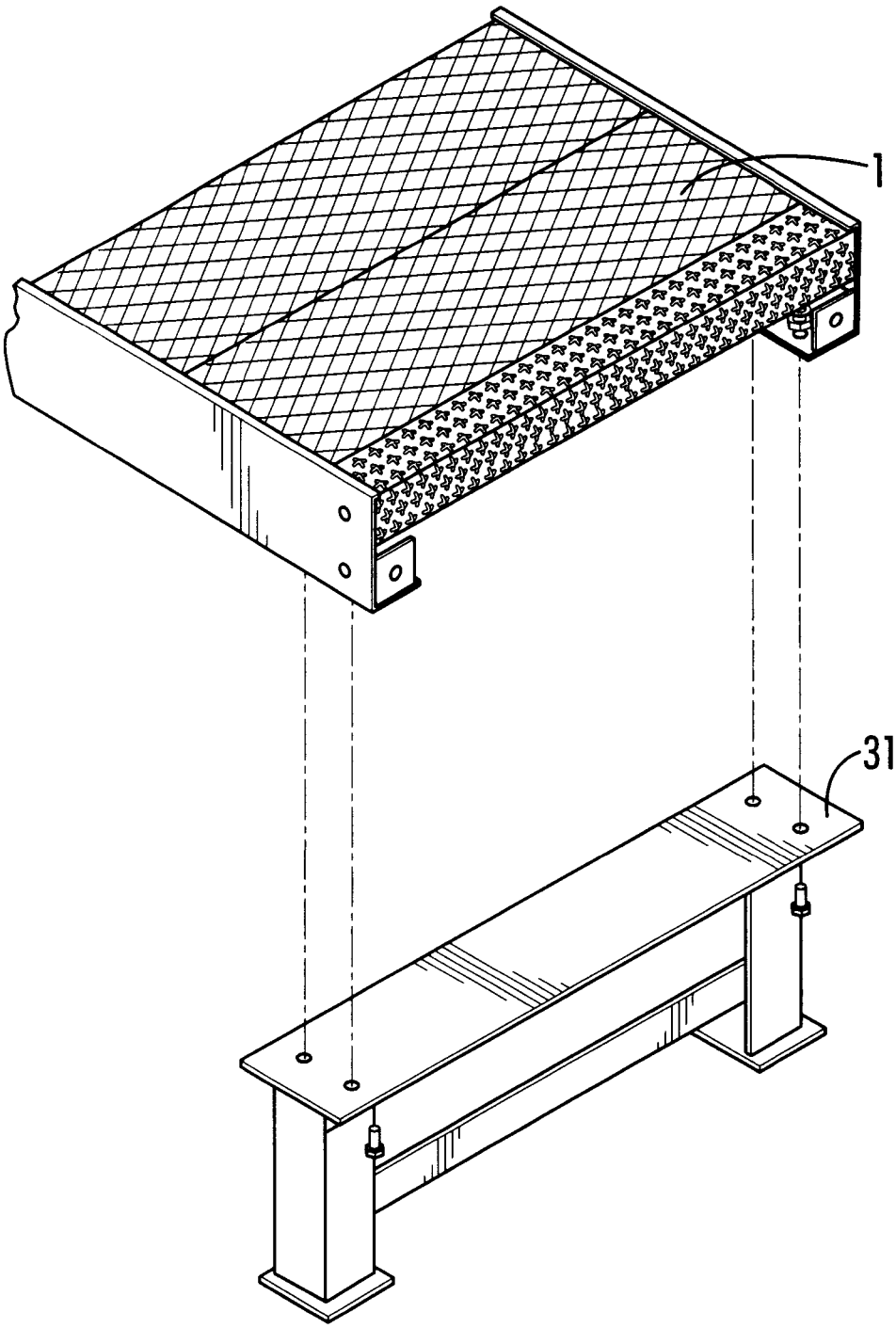
FIG. 10 is a perspective view of a platform member being positioned atop an end support and of the positioning of the fastener holes.

As further shown in FIG. 9 and FIG. 10, a single or a multiply-joined platform unit 1 may be mounted atop an end unit 31 for support by utilizing connecting means such as screws, washers and/or bolts. Fastener holes, as seen in FIG. 10, are provided on the platform unit 1 to align with the fastener holes in the end unit 31 to allow for easy assembly by the users.

Figure 11:
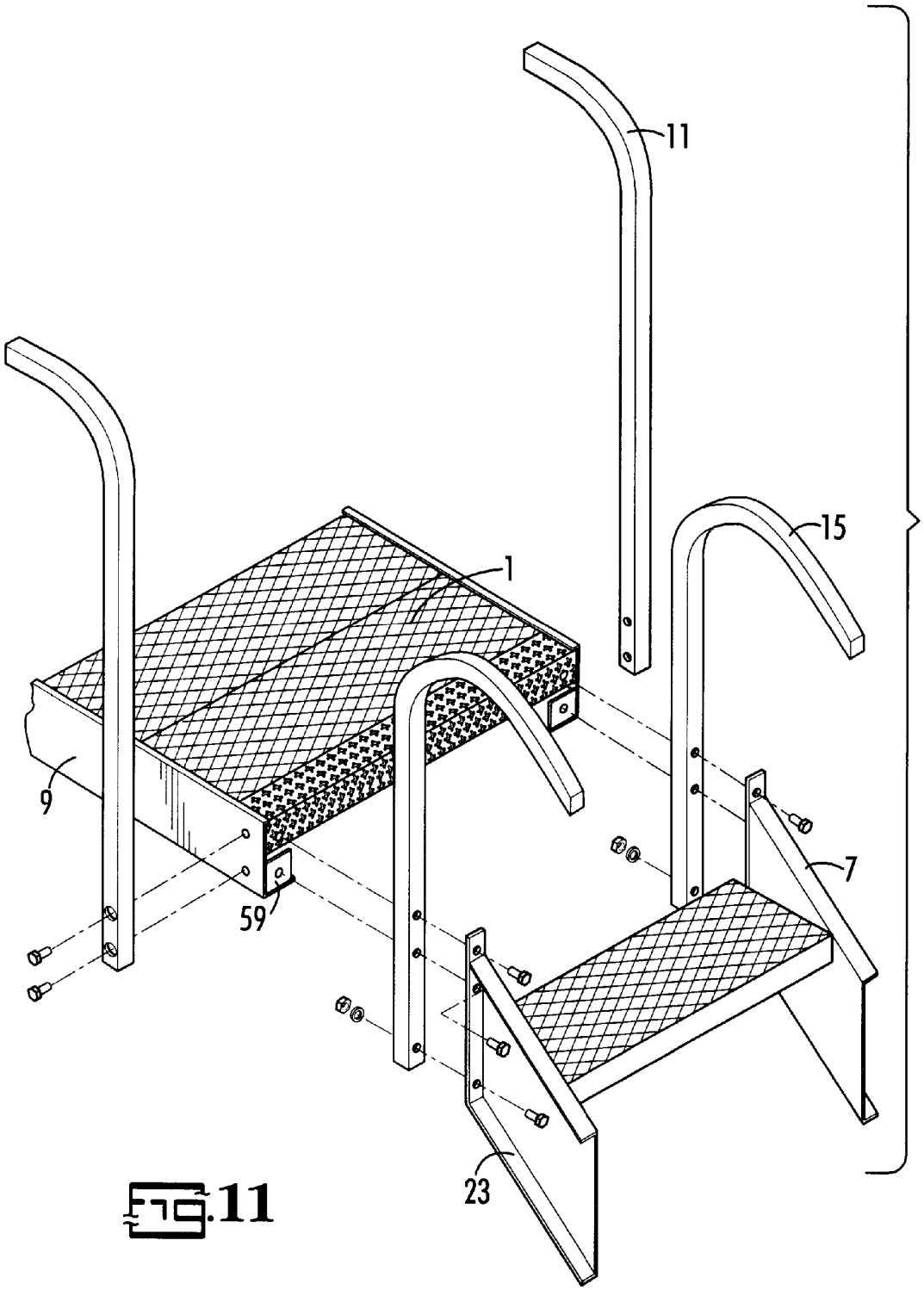
FIG. 11 is a schematic representation of the joining of a platform unit and a stair unit, including the associated railing and of the positioning of the fastener holes and connector means.

Once the platform unit 1 is configured as desired, a stair unit 7 may be attached at an end of the platform unit 1, such as at first end 3 or second end 5. As shown in FIG. 11, stair unit 7 may be aligned with the fastener holes at an end of the platform unit 1. Platform unit 1, comprises an angled portion 59 which is either integral with, welded to or connectable with an interior portion of ledge portion 9 such that a fastener hole in angled portion 59 is alignable with a fastener hole of the stair unit 7.

Figure 12:
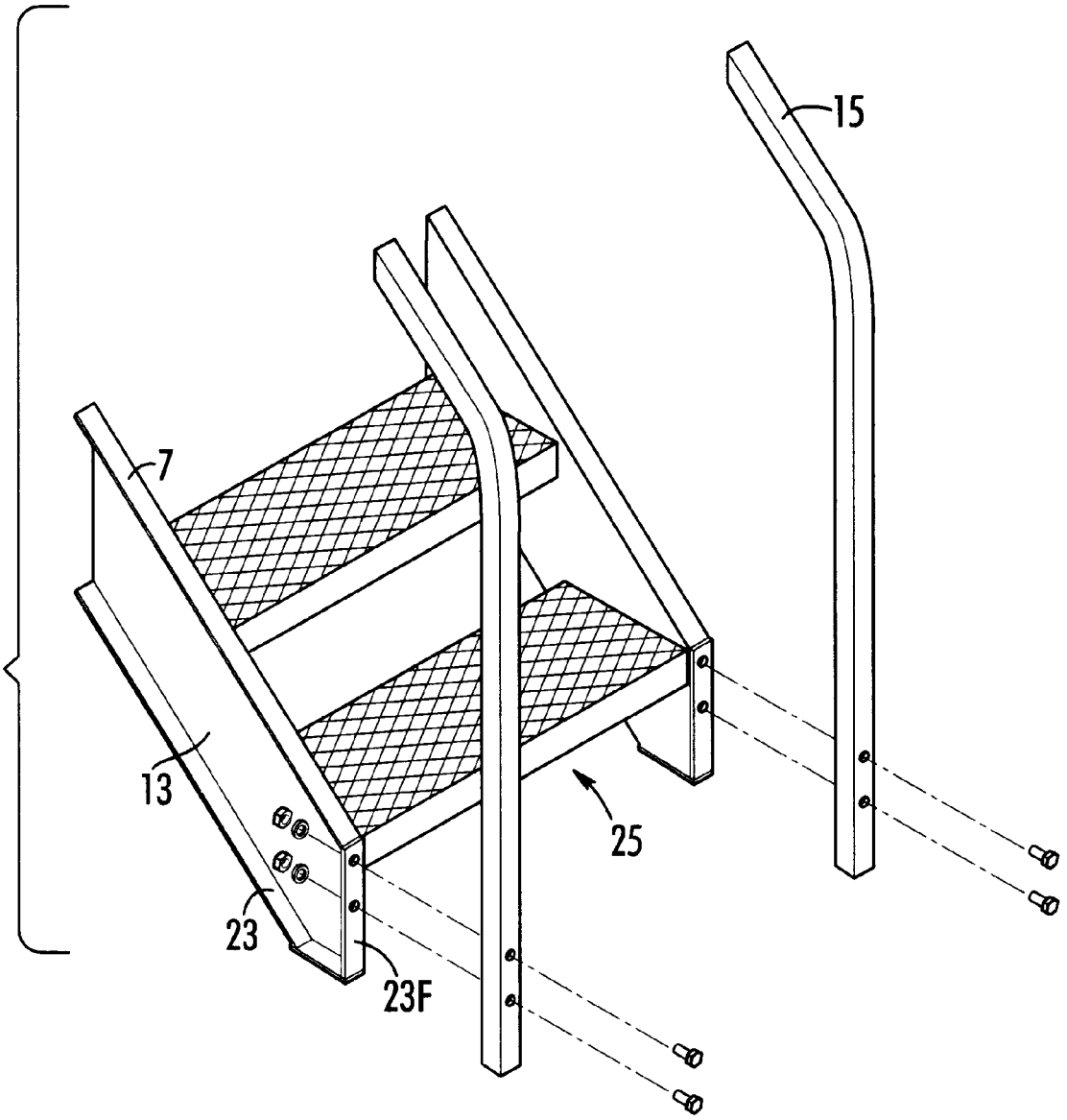
FIG. 12 is a perspective view of a stair unit being joined to a stair railing and of the positioning of the fastener holes.

As further shown in FIG. 11, a stair railing 15 may be connected between the stair unit 7 and platform unit 1 interface. The fastener holes in the stair railing 15 are provided such that they easily align with the fastener holes of the stair unit 7 and the platform unit 1. The stair railing 15 is also attachable to the front end 25 of the stair unit 7 to secure the railing and to provide a stable entry and exit means for the system 10 user (FIG. 12). Platform railing 11 is designed to be in communication with ledge portion 9 of the platform unit 1. Again, fastener holes are provided such that alignment may be accomplished effortlessly.

Figure 13:
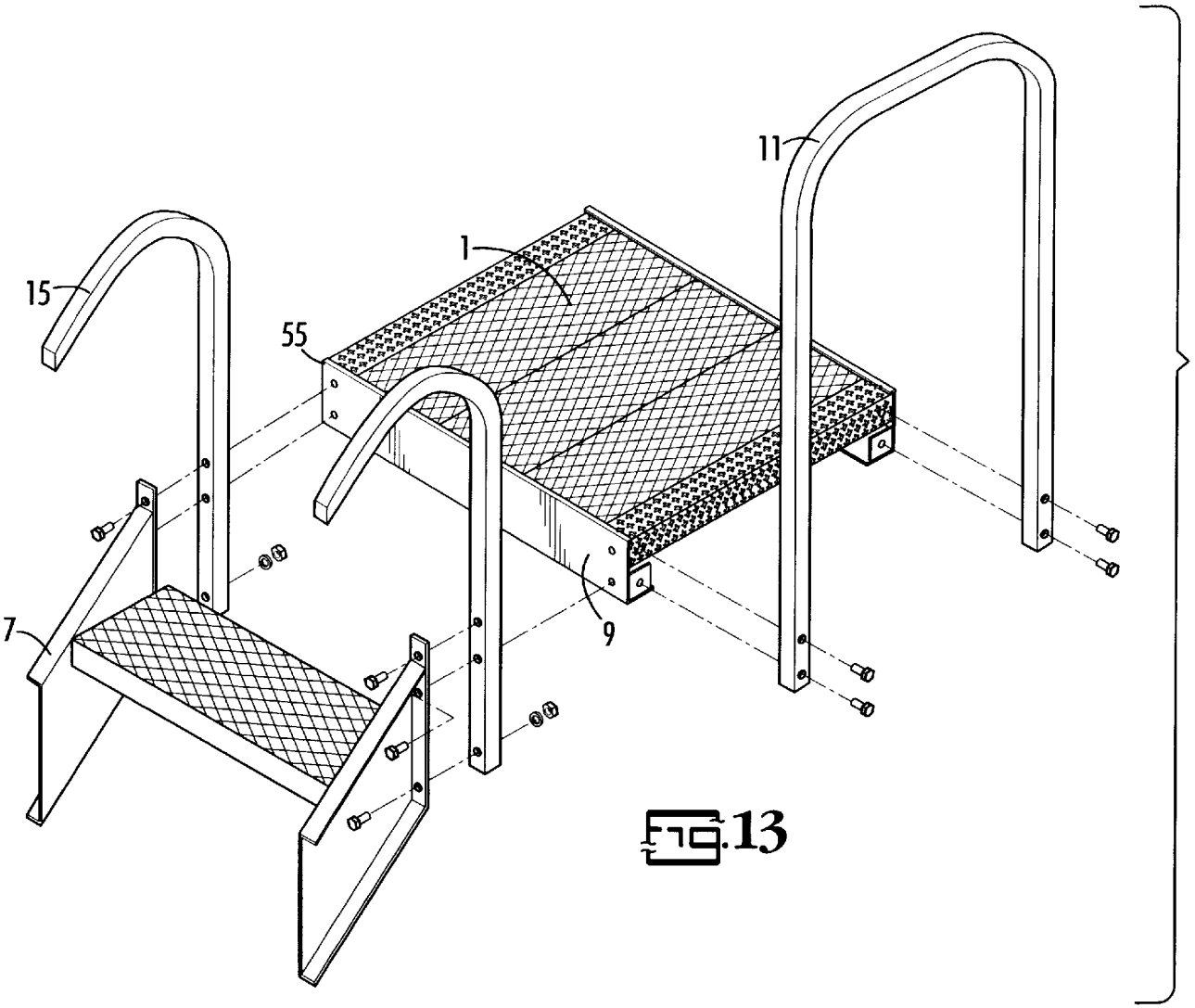
FIG. 13 is a schematic representation of the joining of a stair unit to the side of a platform unit including the associated railing and of the positioning of the fasteners holes and connector means.

As further seen with reference to FIG. 13, the stair unit 7 may be connected to the ledge portion 9 of platform unit 1 at a side 55. As noted above, the fastener holes of stair unit 7 are alienable with the fastener holes of platform unit 1. Stair railing 15 may be positioned between the platform unit 1 and the stair unit 7 interface by simply aligning the fastener holes. In this configuration, the platform railing 11 is positioned at an end of the platform unit 1, such as first end 3 or second end 5, and aligned with the fastener holes of angled portion 59.

Figure 14:
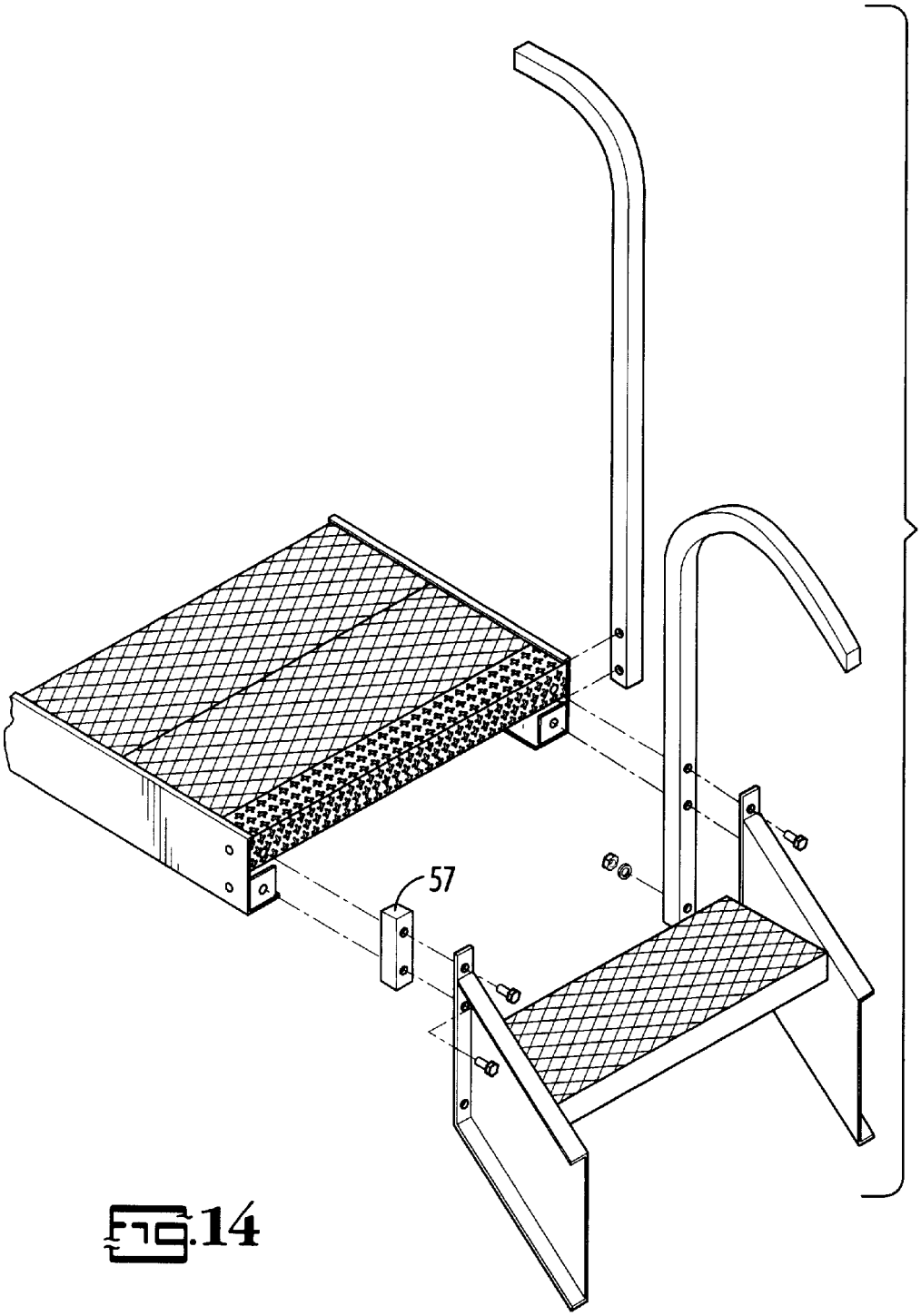
FIG. 14 is a schematic representation of a platform unit being joined to a stair unit, the associated railing and the adapter required when placing the platform and stair unit adjacent a structure.

In certain instances, a platform unit 1 may be configured beside a structure such that railing is only required on a single side of the platform unit 1 and stair unit 7. As see in FIG. 14, the system 10 can accommodate such a configuration with the aid of an adapter unit 57. Adapter 57 is placed between stair unit 7 and platform unit 1 at a position opposite the stair railing 15 so as to accommodate the gap formed between the platform unit 1 and the stair unit 7 due to the presence of the stair railing 15.

Figure 15:
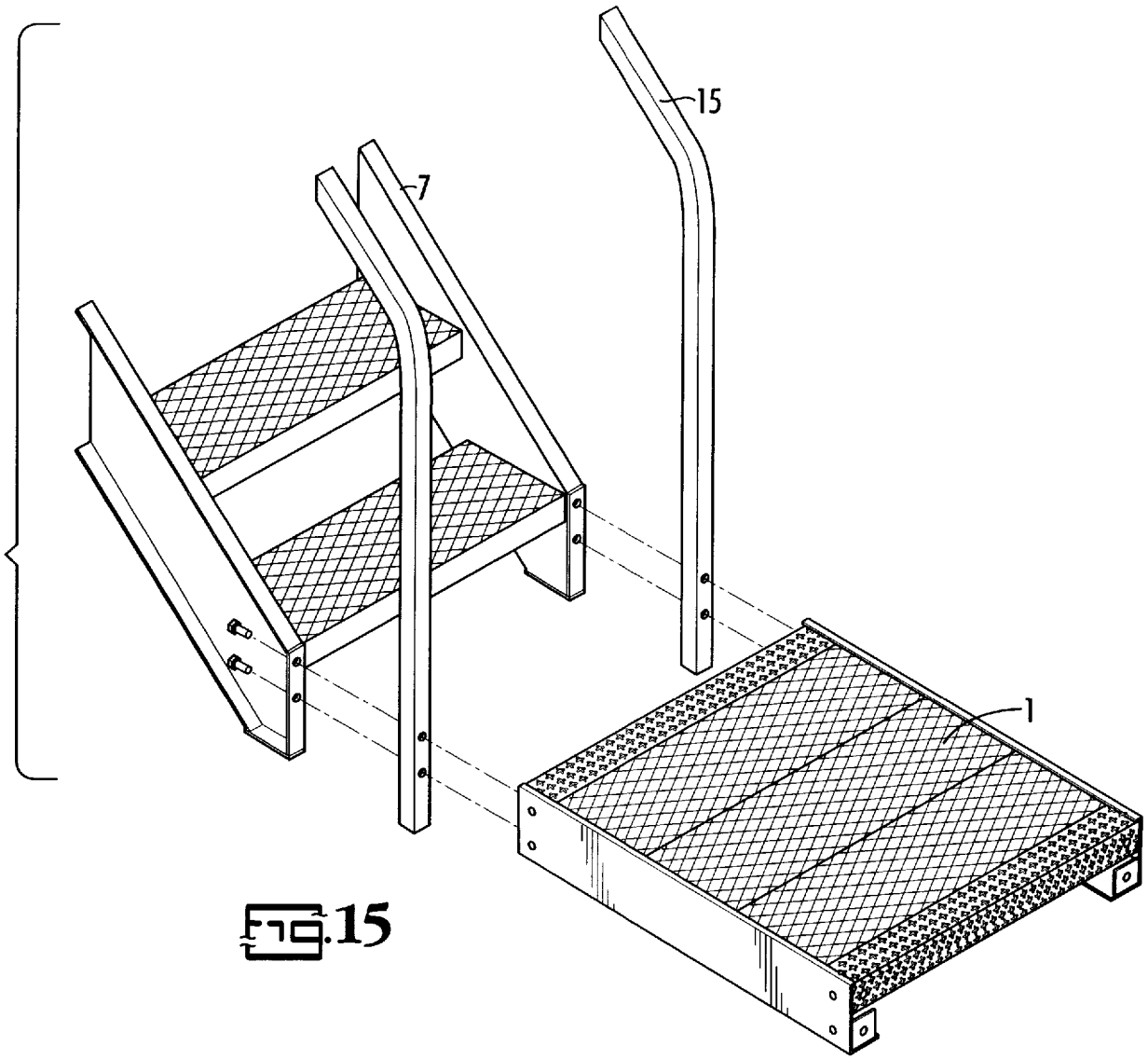
FIG. 15 is a schematic representation of a stair unit being joined to a platform unit and the associated stair railing.

It is also possible to provide a stair unit 7 which leads up to, or down from, a platform unit 1 as shown in FIG. 15. By providing various means for connecting and attaching the components of the system 10, a versatile and easy to assembly system 10 is provided.

Thus, a novel modular platform system has been described. The assembling of the units of the present invention will produce a platform system 1 which is lightweight and easily assembled by the user. The platform system 1 may be designed to have a single or multiple access points and can be built to accommodate various needs for height. The platform system 1 provides various safety features, such as a slip resistant surfacing and stair and platform railings which providing a safe working environment for the user.

Based on the above disclosure, it will be readily understood by those persons skilled in the art that the present invention is susceptible to broad utility and application. Although the preferred embodiment of the present invention utilizes aluminum as its material of choice, it will be clear to those in the art that a variety of other materials may also be suitable for use with the present invention without exceeding the bounds and range of the present invention. Many embodiments and adaptations of the present invention other than those described, as well as many variations, modifications and equivalent arrangements will likewise be apparent from or reasonably suggested by the present invention and foregoing description thereof, without departing from the substance and scope of the present invention. The foregoing disclosure is not intended to be construed to limit the present invention or otherwise to exclude any such other embodiments, adaptations, variations, modifications and equivalent arrangements, the present invention being limited only by the claims appended hereto and the equivalents thereof.

What is claimed:

1. A modular platform system, comprising:

at least one rectangular platform unit of a predetermined size, said platform unit having pre-formed holes at predetermined intervals;

at least one stair unit of a predetermined length connectable with and supporting said at least one platform unit, said at least one stair unit comprising a number of steps between a pair of side rails and having pre-formed holes at predetermined intervals, said side rails being sloped at a predetermined angle with respect to said platform unit;

at least one stair railing unit of a predetermined length, said stair railing unit having a vertical member with pre-formed holes therein, at least one fastener extending through a respective aligned pre-formed hole of said stair unit, said vertical member, and said platform unit connecting said rail unit between said at least one platform unit and said at least one stair unit; and, at least one platform railing unit of a predetermined length, said platform railing unit connectable to said at least one platform unit;

wherein a platform system of varying dimensions can be assembled by a user.

2. A modular platform system according to claim 1 further comprising at least one supporting end unit of predetermined height, connectable with said at least one rectangular platform unit.

3. The modular platform system of claim 1, wherein said platform railing is connectable at a side of said platform.

4. The modular platform system of claim 1, wherein said platform unit has a slip resistant surfacing.

5. The modular platform system of claim 1, wherein said predetermined angle of said slope of said stair unit is about 45 degrees.

6. A modular platform system comprising:

at least one rectangular platform unit of a predetermined size, said platform unit having a first end, a second end, and a ledge portion, said ledge portion having pre-formed holes at predetermined intervals;

at least one stair unit of a predetermined length connectable with and supporting said at least one platform unit, said at least one stair unit comprising a number of steps between a pair of side rails and having pre-formed holes at predetermined intervals, said side rails being sloped at a predetermined angle with respect to said platformed unit;

at least one stair railing unit of a predetermined length, said stair railing unit having a vertical member with pre-formed holes therein, at least one fastener extending through a respective aligned pre-formed hole of said stair unit, said vertical member, and said platform unit connecting said rail unit between said at least one platform unit and said at least one stair unit; and, at least one platform railing unit of a predetermined length, said platform railing unit connectable to said at least one platform unit;

wherein a platform system of varying dimensions can be assembled by a user.

7. A modular platform system according to claim 6 further comprising at least one supporting end unit of predetermined height connectable with said at least one rectangular platform unit.

* * * * *